US005701694A

United States Patent [19]

Atkinson

[11] Patent Number: 5,701,694

[45] Date of Patent: Dec. 30, 1997

[54] TABLETOP ADVERTISING DISPLAY

[75] Inventor: Charles Michael Atkinson, Arkadelphia, Ark.

[73] Assignee: People You Need, Inc., Arkadelphia, Ark.

[21] Appl. No.: 643,250

[22] Filed: May 1, 1996

[51] Int. Cl.[6] ..... G09F 3/18

[52] U.S. Cl. ..... 40/493; 40/124.2

[58] Field of Search ..... 40/124.2, 642, 40/493, 358

[56] References Cited

U.S. PATENT DOCUMENTS

| | | | |
|---|---|---|---|
| D. 358,176 | 5/1995 | Atkinson . | |
| 1,354,026 | 9/1920 | Cox | 40/124.2 |
| 1,481,682 | 1/1924 | Buckingham | 40/493 X |
| 4,432,151 | 2/1984 | Morris . | |
| 4,467,540 | 8/1984 | Gfesser, Jr. | 40/358 X |
| 4,505,059 | 3/1985 | Morris . | |
| 4,727,666 | 3/1988 | Kyler . | |
| 4,738,038 | 4/1988 | Tanne et al. . | |
| 4,839,976 | 6/1989 | Kyler . | |
| 4,967,496 | 11/1990 | Kyler | 40/124.2 X |
| 5,083,391 | 1/1992 | Kyler | 40/642 |

*Primary Examiner*—Joanne Silbermann
*Attorney, Agent, or Firm*—Ray F. Cox, Jr.

[57] ABSTRACT

A tabletop advertising display and dispensing apparatus adapted for the display of advertising material to patrons of places of business and the holding and dispensing of articles, such as condiments, brochures, or other items carried in a receptacle. The apparatus also has the capability of dispensing coupons. The article-holding receptacles may be removed and replaced by receptacles designed for the holding and dispensing of other articles. The advertising display and coupon dispensing portions of the apparatus may be combined with receptacles specifically designed for specific places of business, such as restaurants, medical offices, or hotels.

3 Claims, 9 Drawing Sheets

11
11
12
13
10
SHOW
TONITE
20
PUSH
SHOW
PUSH
21
30
42

11
11
10
12
12
13
13
SHOW
TONITE
TROUT T
PUSH
PUSH
PUSH
PUSH
21
30
21

FIG. 7
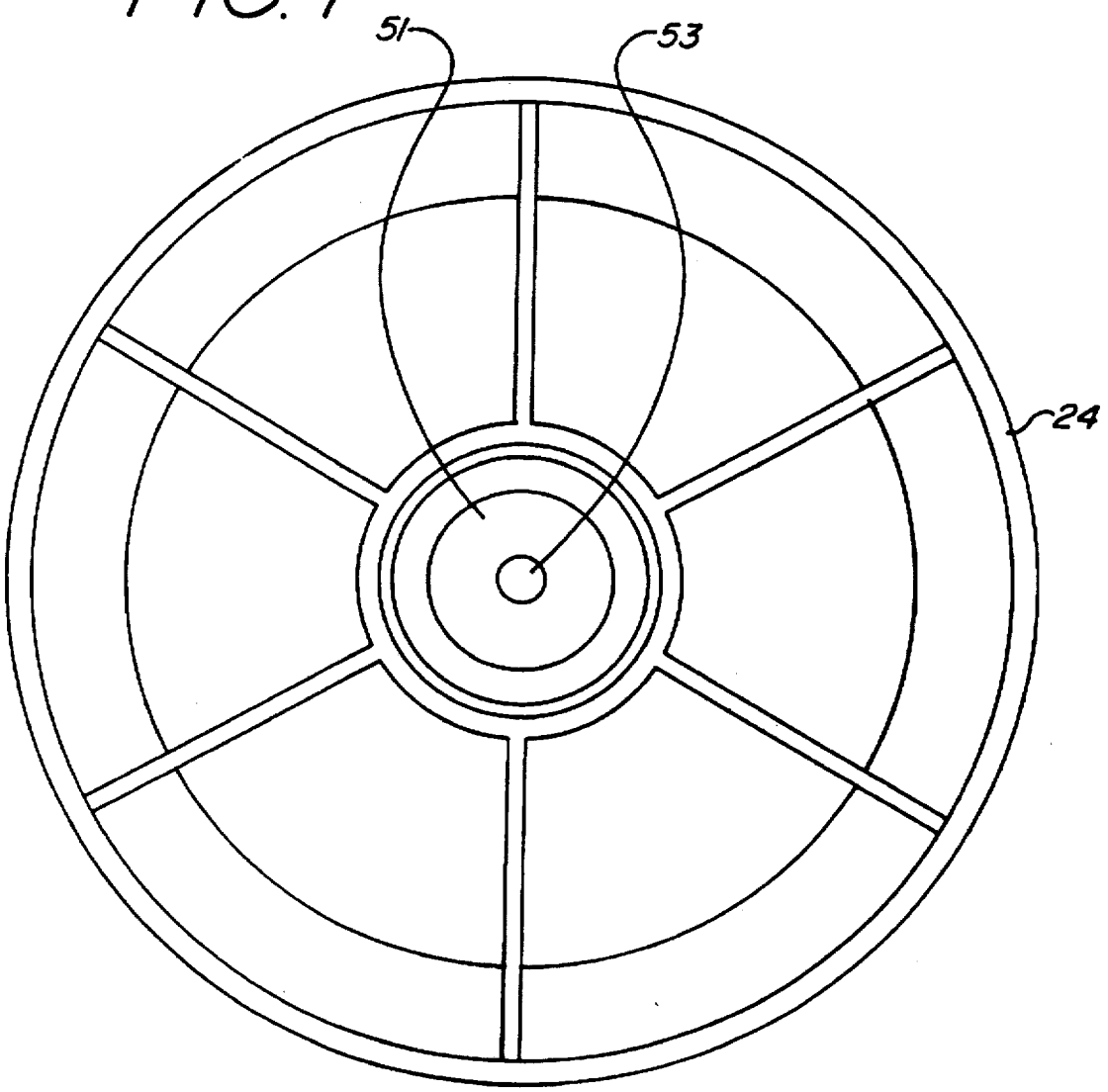
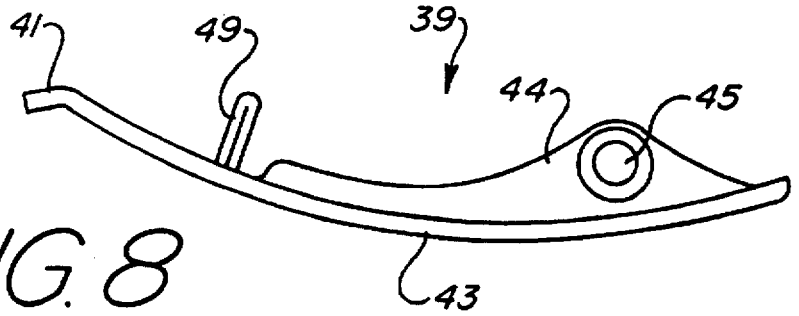
FIG. 8

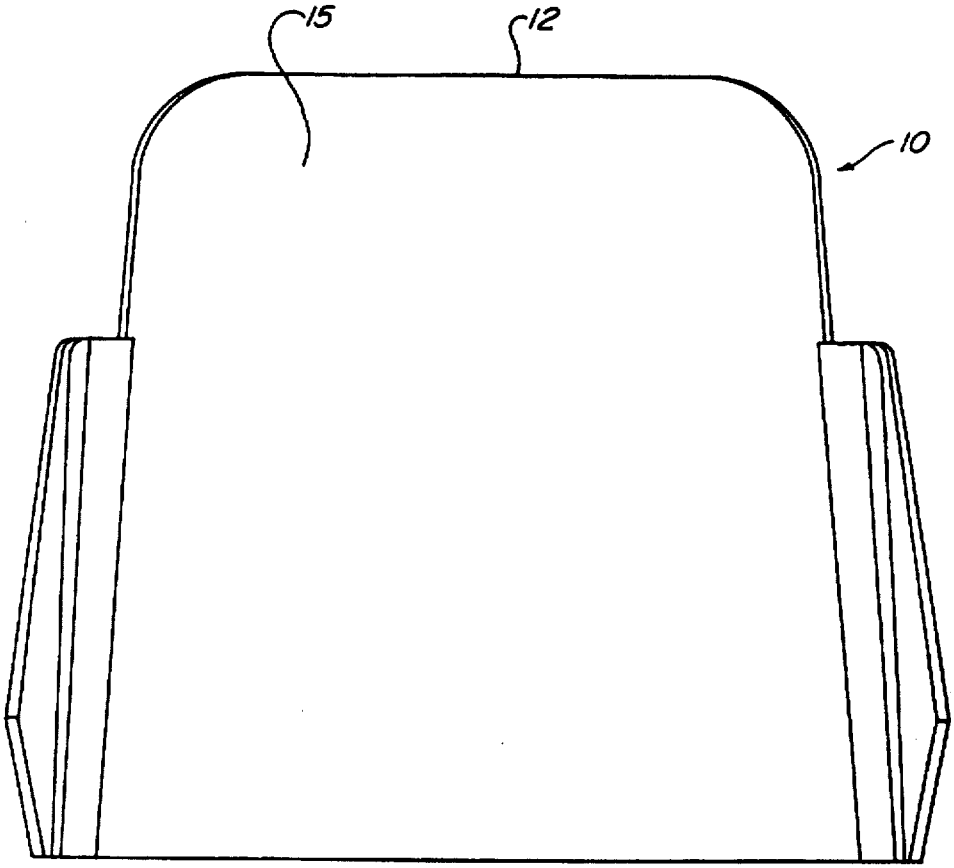
FIG. 9
FIG. 10
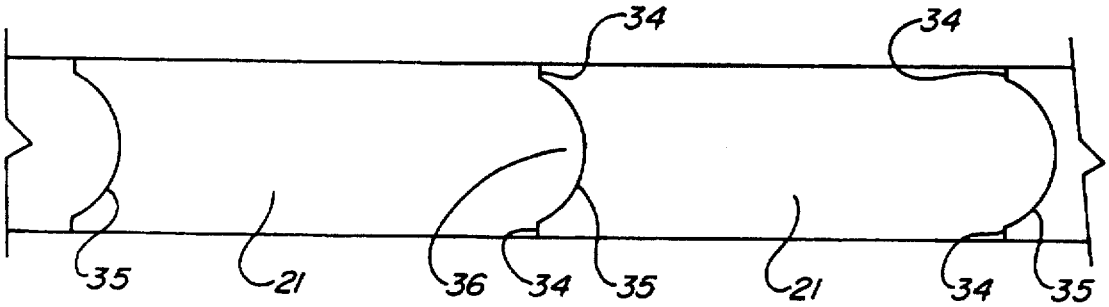

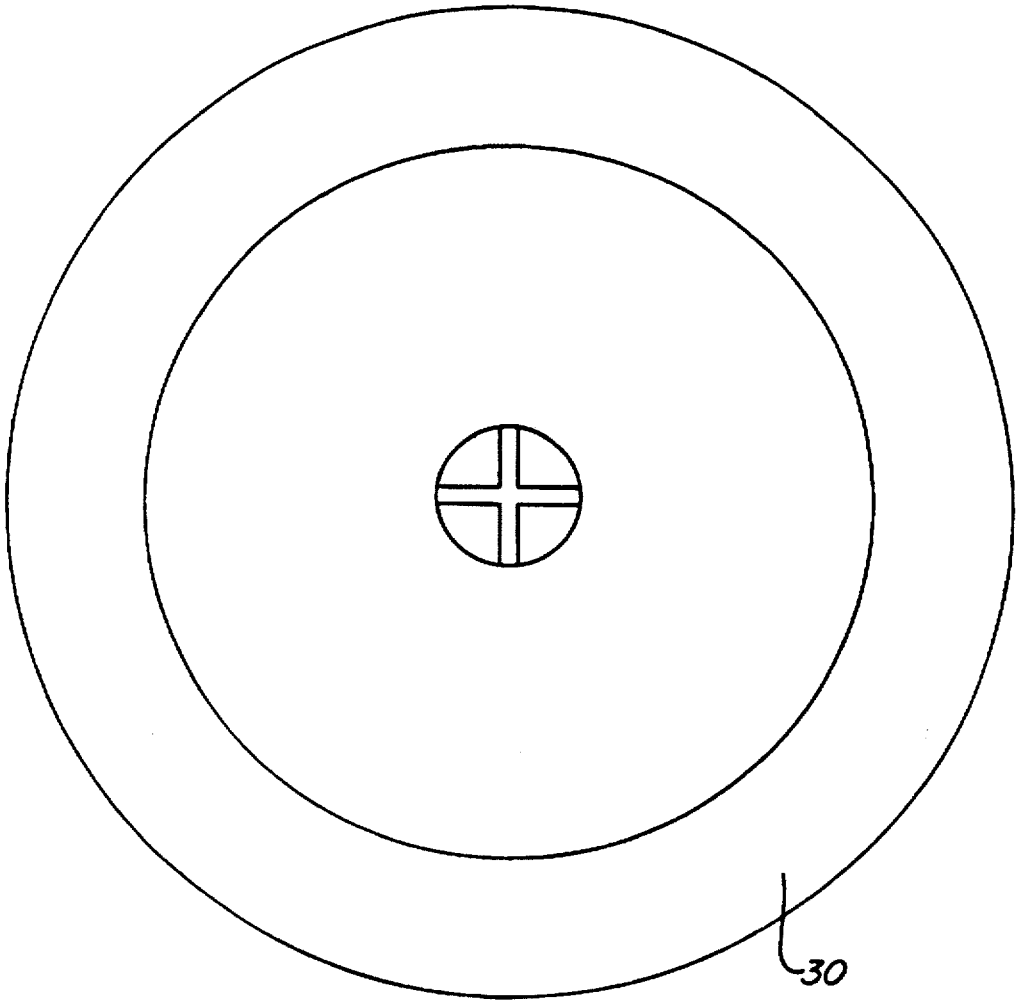
FIG. 11
FIG. 12
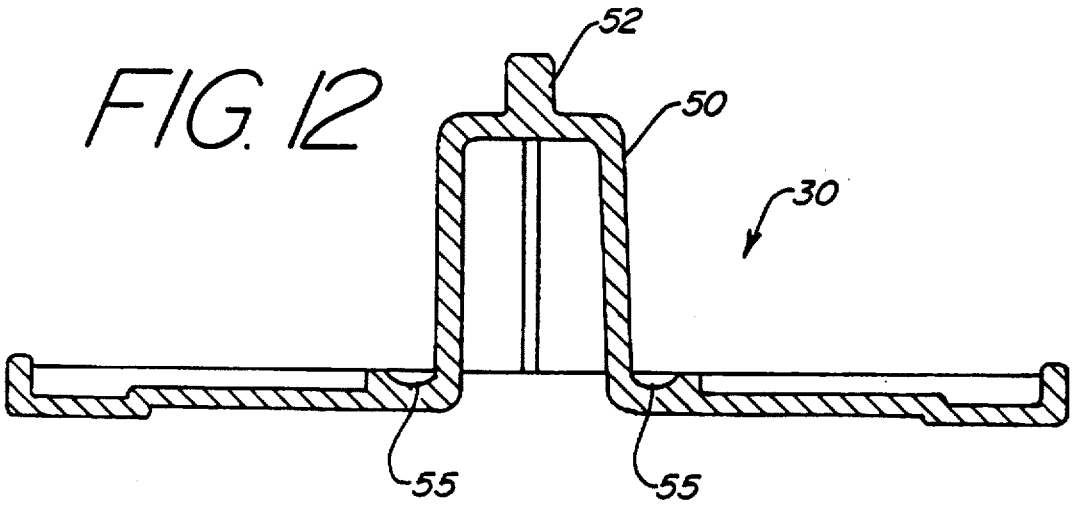

TABLETOP ADVERTISING DISPLAY

BACKGROUND OF THE INVENTION

This invention relates to a tabletop advertising display and dispensing apparatus adapted for the display of advertising material to patrons of places of business and the dispensing of items, such as condiments, brochures, or other items carried in a receptacle. This invention further relates to such an advertising and dispensing apparatus which has the capability of dispensing coupons.

Various places of business provide excellent opportunities for the presentation of advertising materials to the public. For example, restaurant patrons are effectively a captive audience for any advertising materials placed within their purview. The same principle holds for numerous other types of places of business, including medical and dental offices and even hotel or motel rooms.

It is known to provide for tabletop display of advertising materials along with the dispensing of articles from some type of receptacle. The dispensing of articles along with the advertising display is desirable in many applications; for example, in restaurants where the receptacle can hold condiments or the like. Such devices are disclosed in various patents including U.S. Pat. No. 5,083,391, U.S. Pat. No. 4,839,976, U.S. Pat. No. 4,738,038, U.S. Pat. No. 4,727,666, U.S. Pat. No. 4,505,059, and U.S. Pat. No. 4,432,151.

It has also been suggested that such advertising displays could incorporate coupon dispensers, although the present inventor is unaware of any device that has actually incorporated coupon dispensers into a tabletop advertising display.

The prior art in tabletop advertising displays has focused on the use of such displays in restaurant settings. Therefore, the prior art designs have shown receptacles for dispensing articles for use by restaurant patrons, such as condiments, packets of sweeteners, or the like. As noted above, however, tabletop advertising displays are not limited in applicability to restaurants. Medical or dental offices have the same kind of captive audience as restaurants, but no need for condiment receptacles. Advertising displays of similar type can effectively be utilized to dispense articles of interest to the patrons of medical or dental offices, such as brochures detailing health advice. Likewise, hotel or motel rooms can advantageously combine advertising displays with travel or tourist information in the form of brochures and the like.

While it has been suggested that tabletop advertising displays may be combined with coupon dispensers, the prior art has not suggested the distinct advantages to accrue from the coordinated dispensing of coupons and brochures related to the same subject as the advertising display. As an example, a hotel room tabletop advertising display might display materials related to a local tourist attraction. Brochures regarding the same tourist attraction would be available in an integral dispenser and coupons for discounts for the tourist attraction or related enterprises, such as nearby eating establishments, would be available also. The prior art has not recognized the value of such integrated marketing efforts.

SUMMARY OF THE INVENTION

It is therefore a general object of the present invention to overcome the disadvantages and limitations of the prior art by combining an advertising display with a coupon dispenser and a receptacle for holding and dispensing other articles.

It is also an object of the present invention to provide for such a combined advertising display, coupon dispenser and article receptacle in a tabletop device.

A further object of the present invention is to provide for varying article receptacles to accommodate the needs of the patrons of various places of business, such as restaurants, medical or dental offices, and hotels or motels. This is accomplished by providing for receptacles having any one purpose that may be removed and replaced by receptacles designed for the holding and dispensing of other articles. Thus the advertising display and coupons dispensing portions of the present invention may be combined with receptacles specifically designed for restaurants or for medical offices or for any other specific place of business. It should be understood that the expression "place of business" is not limited to commercial establishments but is intended to encompass any place open to the public wherein advertising material may be advantageously displayed.

It is also an object of the present invention to provide for a method of using a tabletop advertising display in which the advertising display is coordinated with integral coupon dispensing and the provision of a receptacle for the holding and dispensing of articles, such as brochures.

Further objects and advantages of the present invention will become apparent from consideration of the detailed description of the preferred embodiment in conjunction with the drawings described as follows.

BRIEF DESCRIPTION OF THE DRAWINGS

FIG. 7 is a bottom view of the base plate of the coupon dispenser.

FIG. 8 is a top view of the spring-loaded feeder which guides the coupons from the coupon dispenser.

FIG. 9 is a front elevation view of the receptacle/advertising assembly.

FIG. 10 is a partial front elevation view of a segment of coupons.

FIG. 11 is a bottom view of the pedestal on which the receptacle/display/dispenser assembly rotates.

FIG. 12 is a sectional elevation view of the pedestal.

DETAILED DESCRIPTION OF THE PREFERRED EMBODIMENTS

Figure 1:
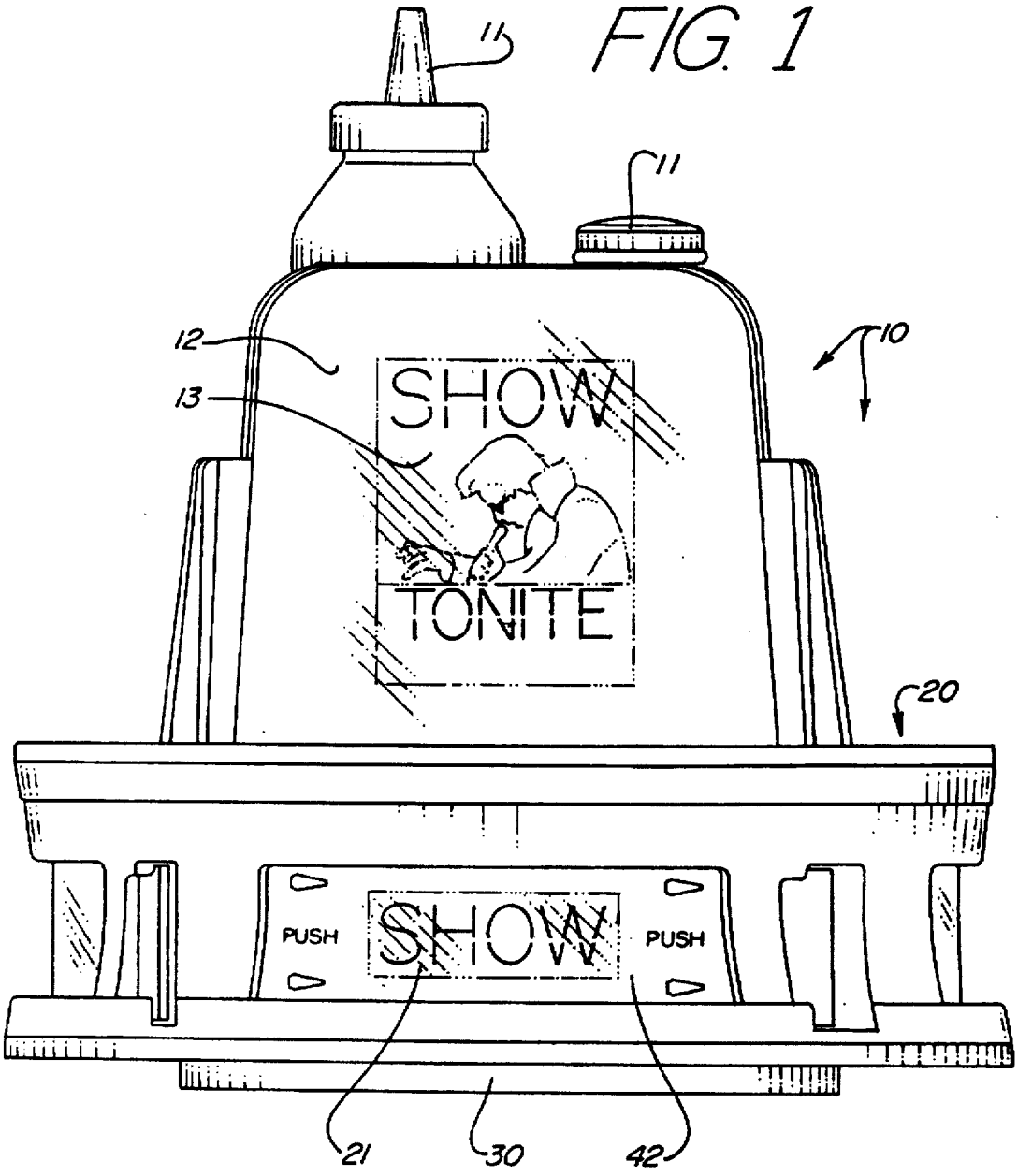
FIG. 1 is a front elevation view of the tabletop advertising display showing the condiment receptacle.
Figure 2:
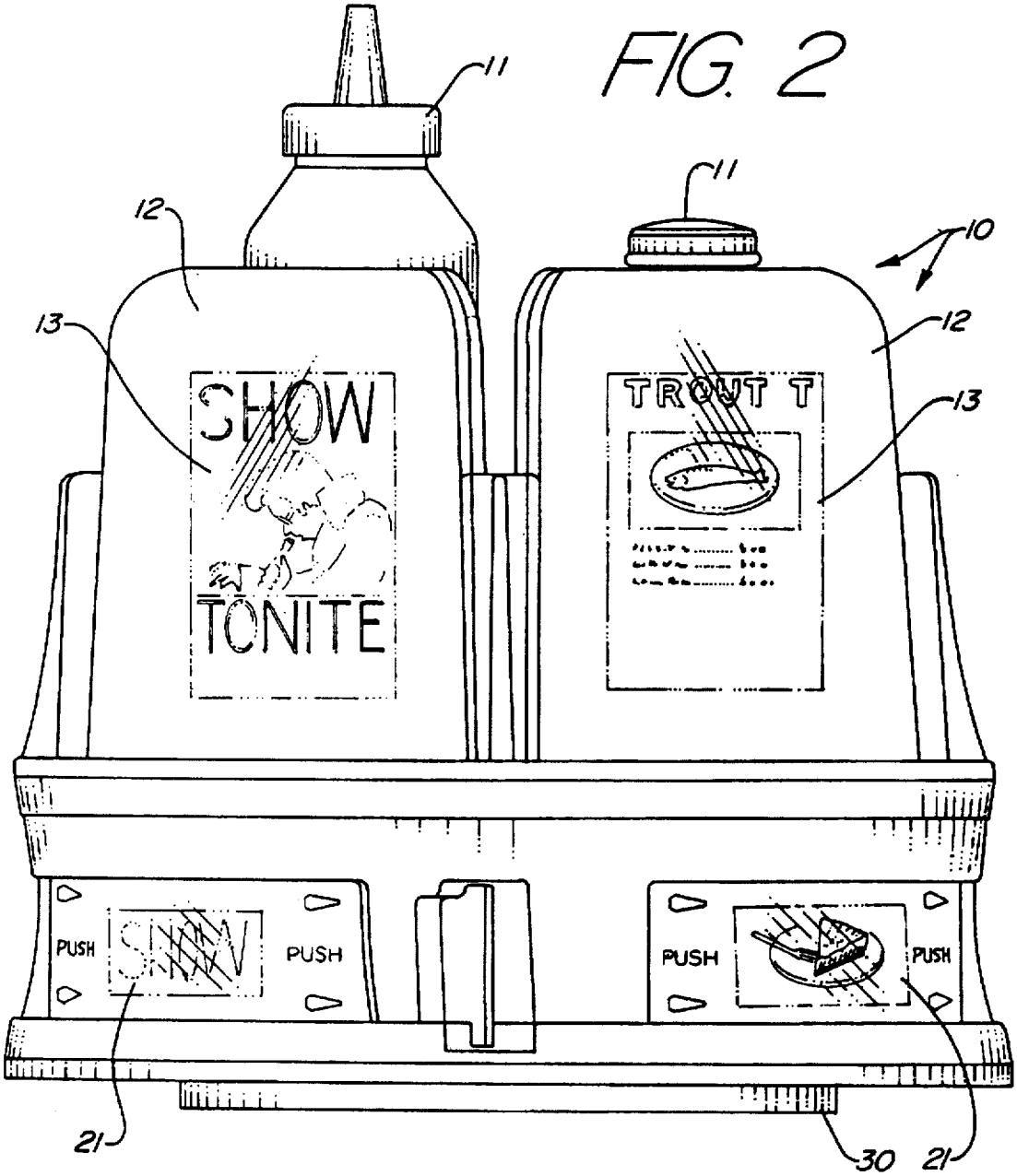
FIG. 2 is a right oblique view of the tabletop advertising display showing the condiment receptacle.
Figure 3:
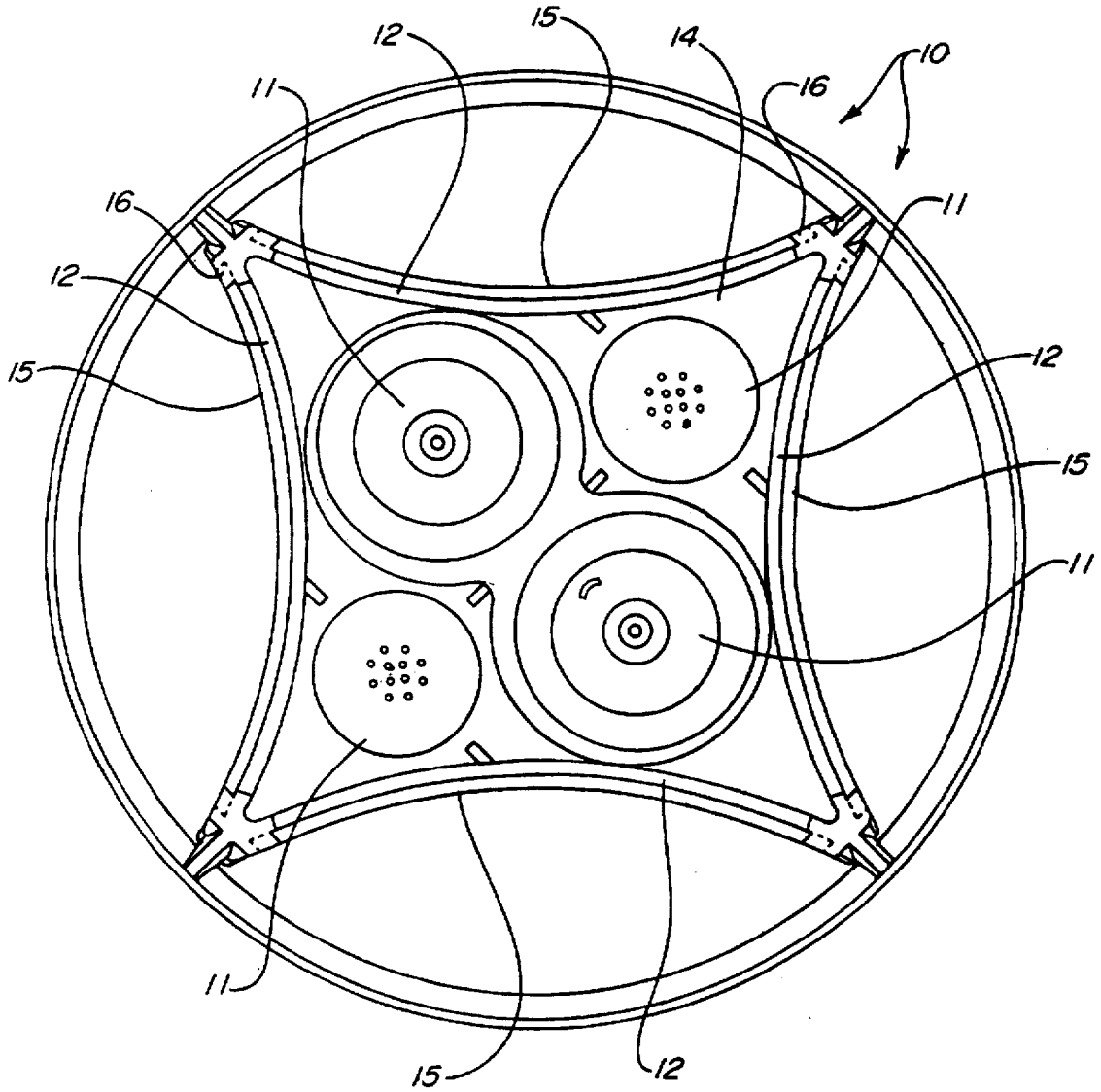
FIG. 3 is a top view corresponding to FIG. 1 of the tabletop advertising display showing the condiment receptacle.
Figure 4:
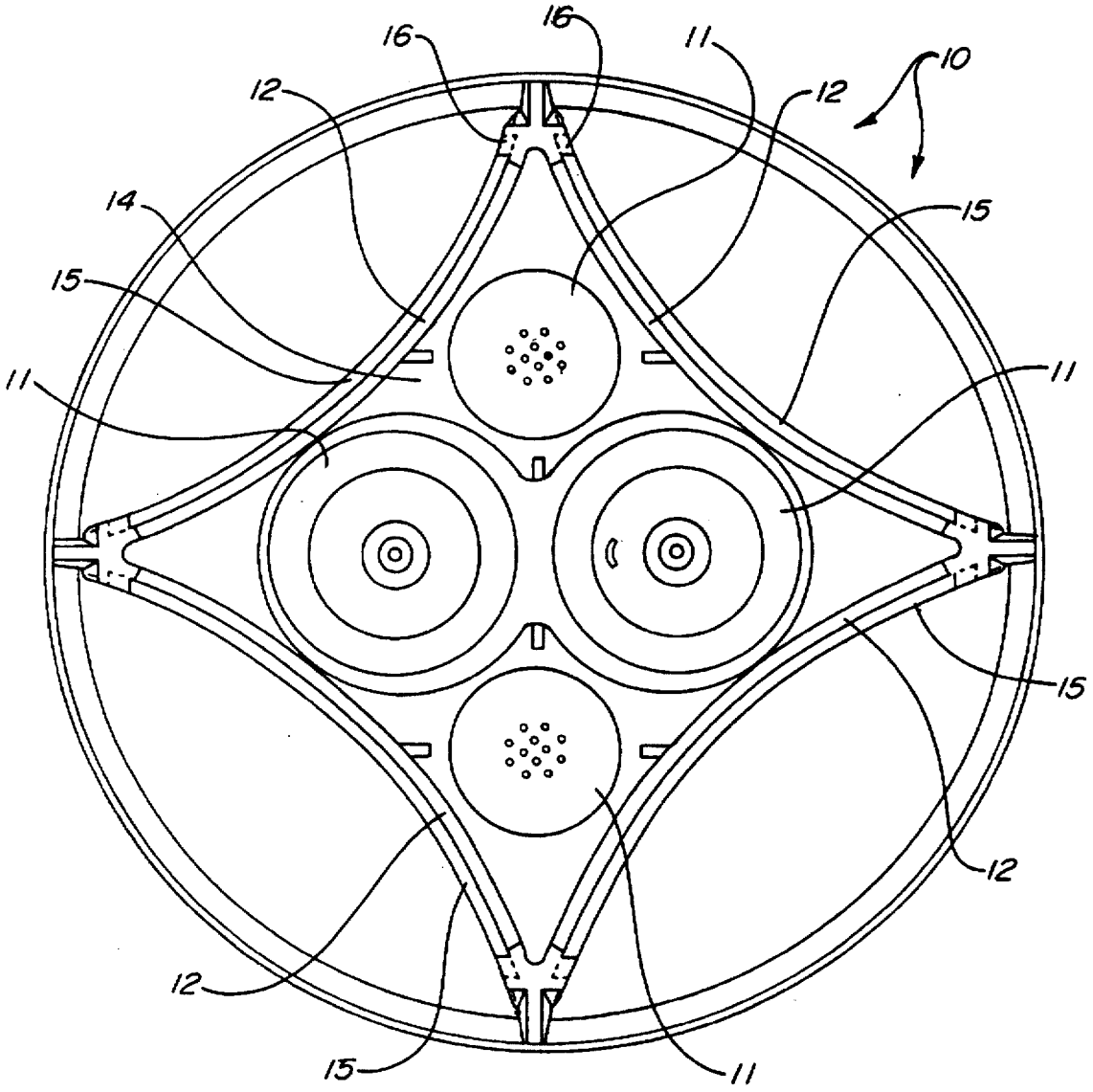
FIG. 4 is a top view corresponding to FIG. 2 of the tabletop advertising display showing the condiment receptacle.

The general appearance of the tabletop advertising display of the present invention may be described with reference to FIGS. 1 and 2. The main components are a condiment receptacle/advertising assembly 10 and coupon dispenser 20. The combined receptacle/advertising assembly 10 and coupon dispenser 20 rotate upon a lazy susan type of pedestal 30 in a manner to be described more fully hereinafter.

The receptacle/advertising assembly 10 in the preferred embodiment holds condiments 11 for selection and use by patrons of a place of business, for example a restaurant. It is to be understood herein that the term "place of business" is not limited to commercial establishments but is intended to encompass any place open to the public wherein advertising material may be advantageously displayed. In the preferred embodiment, the present invention would be placed on a tabletop of a restaurant for ease of access to a patron of the restaurant. The use of the present invention as a condiment dispenser therefore provides a useful function which is both necessary and desirable for most retail dining establishments. The present invention is, however, designed for the primary purpose of presenting advertising materials to the patrons of the restaurant or other place of business.

Each tabletop advertising display of the present invention is provided with a plurality of advertising displays 12 on which is displayed an advertisement 13. Furthermore, each tabletop advertising display of the present invention is provided with a coupon dispenser 20 which provides a plurality of coupons 21 for dispensing to the patrons of the place of business. Each advertising display 13 may be tied to an associated coupon 21 so that the coupon 21 relates to the subject matter of the advertisement 13. The present invention is not so limited, however, and a particular advertisement 13 may not necessarily be related to the coupon 21 located in proximity to the particular advertisement .13.

In a manner to be described more fully hereinafter, the combined receptacle/advertising assembly 10 and coupon dispenser 20 rotate on top of a pedestal 30 so that each of the plurality of advertisements 13 and coupons 21 may be presented in turn to the view of the patron. This rotation capability provides for ease of access to the condiments 11. While the preferred embodiment of the present invention is described with reference to an embodiment in which the receptacle/advertising assembly 10 is adapted to holding and dispensing condiments 11, the present invention is intended to encompass other types of receptacles for the dispensing of articles which would be of interest to the patrons of a place of business. For example, the present invention could be advantageously employed in medical or dental offices in which case the receptacle/advertising assembly 10 could be adapted to hold and dispense articles of interest to the patrons of such establishments, for example brochures on health and related matters. A similar adaptation of the present invention could be advantageously employed in hotel or motel rooms. In this situation the receptacle/advertising assembly 10 could be adapted to hold and dispense articles of interest to the patrons of the hotel or motel. As an example only, and not by way of limitation to the scope of the present invention, the present invention in the hotel or motel setting could be used to dispense brochures describing local tourist attractions or dining establishments. Advantageously, the advertisement 13 and coupon 21 could be coordinated to the brochures available for selection from the receptacle/advertising assembly.

The receptacle/advertising display 10 may be described in mote detail with reference to FIGS. 3, 4, 5 and 9. As shown in FIG. 9, the receptacle/advertising assembly may be molded as a single unit which fits on top of the coupon dispenser tray 22 and is removably held in place by a screw 23. With particular respect to FIGS. 3, 4 and 5, it may be seen that the receptacle/advertising assembly 10 comprising a plurality of advertising displays 12 which enclose and surround a condiment tray 14. The condiment tray 14 may be sized to hold condiments 11 of varying sizes and shapes. In the preferred embodiment, the condiment tray 14 is molded along with the advertising displays 12 as an integral unit which together comprises the receptacle/advertising assembly. The condiment tray 14 may, however, be configured as a separate drop-in unit received in the space formed by the plurality of advertising displays 12. This provides flexibility in accepting varying types and sizes of condiments 11. Furthermore, in the embodiment of the present invention in which the condiment tray 14 is removable, various other receptacles may be placed in the present invention in place of the condiment tray 14. For example, a receptacle with a substantially flat bottom and straight sides may advantageously be employed to receive and dispense brochures and the like. Alternatively, a receptacle having a tiered bottom may be even more advantageous in displaying brochures for viewing and selection by a patron.

The advertising displays 12 are provided with a removable clear window 15 behind which selected advertisements 13 may be placed. The clear windows 15 are received in notches 16 in the advertising displays 12 which taper together toward the top of the receptacle/advertising assembly. The clear windows 15 may therefore be removed by sliding toward the bottom of the receptacle/advertising assembly. The advertisement 15 may then be placed in position in the advertising display 12 after which the clear window 15 is slid upward from the bottom of the receptacle/advertising assembly until it is seated in the notches 16. Once the receptacle/advertising assembly 10 is attached to the coupon dispenser 20 by means of the screw 23, the clear windows 15 and associated advertisements 13 are securely positioned in the advertising displays 12.

The coupon dispenser 20 may be described with reference to FIGS. 5–8 and 10. The coupon dispenser 20 comprises a coupon tray 22 and a base plate 24. The coupon dispenser tray 22 is formed with a lip 25 which receives the receptacle/advertising assembly 10 and holds it firmly in place on top of the coupon dispenser tray 22. The tray 22 is provided with a plurality of latching fingers 26 which depend from the top of the coupon tray 22 and which pass through slots 27 in the bottom plate 24. The latching fingers 26 are provided with a notch 28 which engages the edge of the slot 27, thus locking the bottom plate 24 to the coupon tray 22. In FIG. 6 it should be noted that only one slot 27 is shown by broken lines. Each of the latching fingers 26 is, however, associated with its respective slot 27 although not shown on FIG. 6.

By means of the latching fingers 26 and slot 27, the coupon tray 22 is removably attached to the bottom plate 24. This allows access to the coupon tray 22 for replenishing the supply of coupons. This mechanism also allows access to the screw 23 so that the receptacle/advertising assembly may be removed from the coupon tray 22, thus allowing the advertising displays 12 to be changed as necessary.

In order to provide for alignment and structural rigidity, the coupon tray 22 is provided with a plurality of posts 29 which depend from the top of the coupon tray 22 and which engage complementary recesses 31 in the bottom plate 24. The coupon tray 22 is provided with a plurality of coupon roll holders 32. Each coupon roll holder is provided with a central spool 33 which in the preferred embodiment is molded integrally with the coupon tray 22. Each coupon roll holder 32 is designed to accept a roll of coupons of which a segment is illustrated in FIG. 10. These coupons are commercially available. Each coupon 21 is attached to an adjacent coupon 21 by two short tear-away segments 34 and a semi-circular perforated segment 35 between the two tear-away segments 34. As will be described more fully hereinafter, this arrangement allows each coupon to be presented to the patron for removal from the coupon dispenser. As each coupon advances, the preceding coupon is removed and the semi-circular perforated segment 35 forms a tab 36 which may be grasped by the patron for removal of the succeeding coupon 21.

Continuing with FIG. 6, each coupon roll holder 32 is also provided with a viewing slot 37 which allows for direct inspection of the quantity of coupons 21 remaining in the coupon roll holder 32.

The coupons 21 are fed from the coupon roll holder 32 into a channel formed between the exterior wall 38 of the coupon tray 22 and a spring loaded feeder 39. The exterior wall 38 terminates in a knife edge 40 which assists in tearing one coupon 21 from the succeeding coupon. Furthermore, the feeder 39 terminates in an outward facing ramp 41 which serves to push the tab 36 of the succeeding coupon 21 outward for ease of grasping by the patron. The exterior wall 38 of the coupon tray 22 is advantageously provided with a coupon window 42 of clear material so that the coupon 21 may be viewed by the patron.

Figure 5:
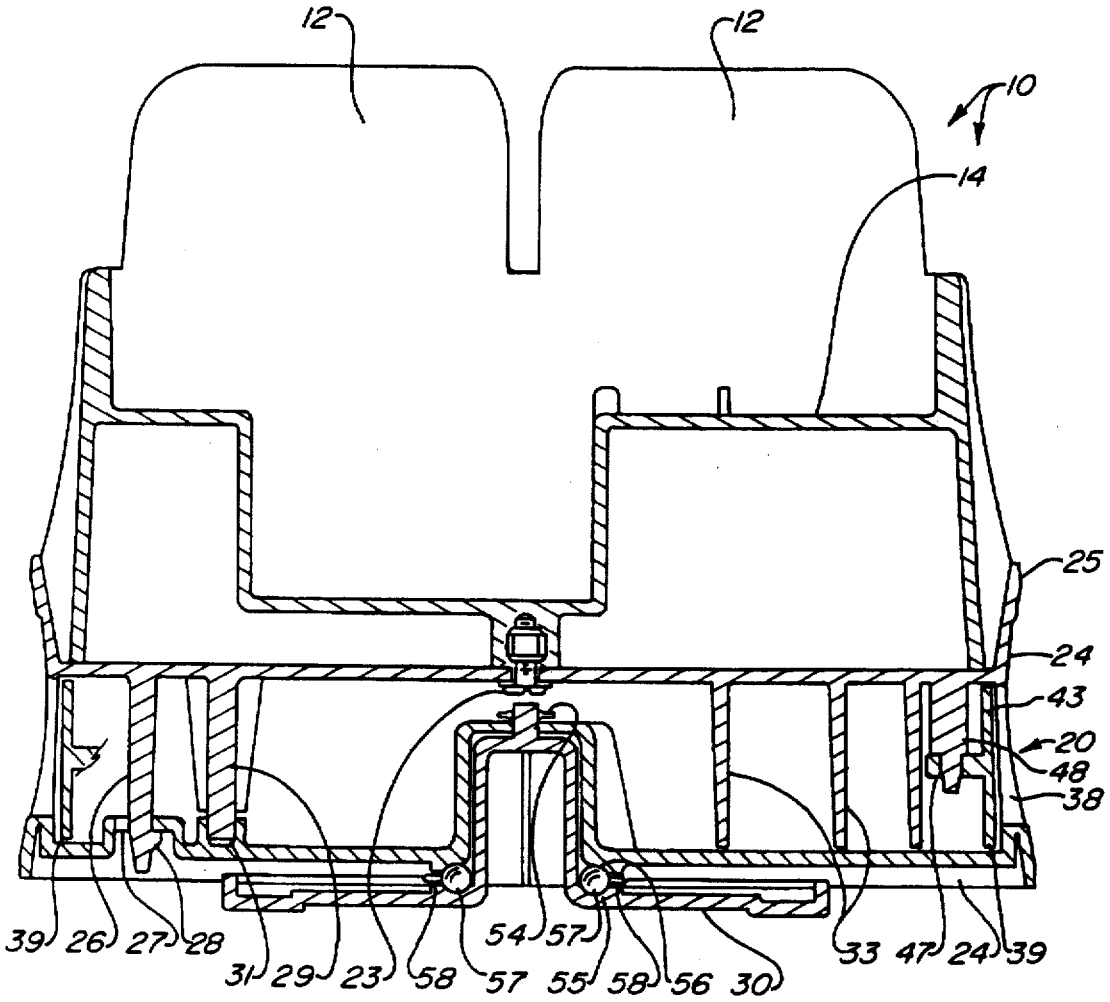
FIG. 5 is a sectional front elevation of the tabletop advertising display.
Figure 6:
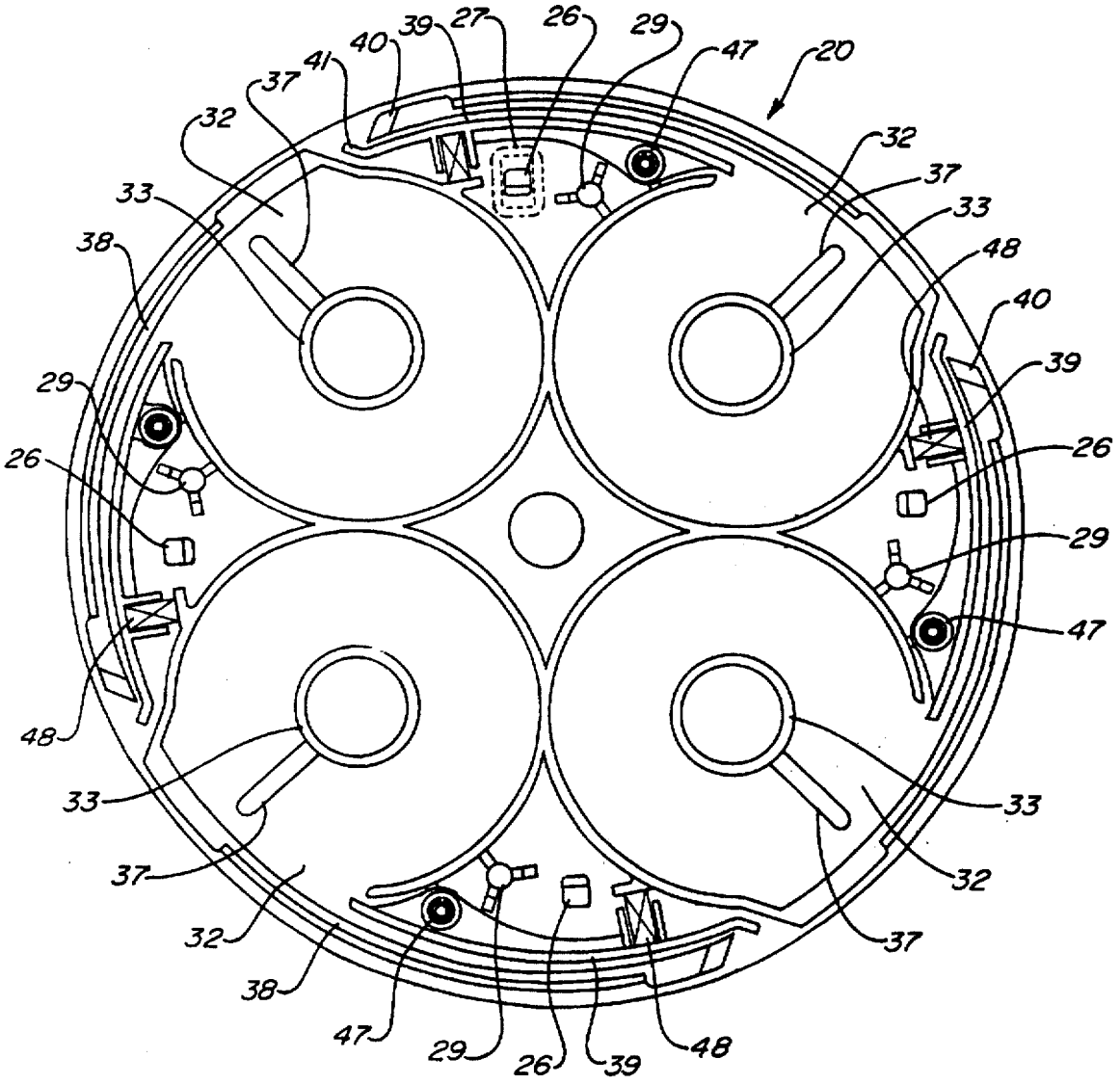
FIG. 6 is a bottom view of the coupon dispenser tray with the base plate removed.

The feeder 39 is described with particular reference to FIGS. 5, 6 and 8. The feeder 39 is provided with a curved vertical wall 43 which conforms substantially to the exterior wall 38 of the coupon tray 22. A horizontal flange 44 attached to the curved vertical wall 43 is provided with a circular opening 45 which is received onto a pivot post 46 and fastened thereto by a retainer 47. The retainer 47 is lose enough to allow the feeder 39 to rotate about the pivot post 46 to the extent allowed by the configuration of the surrounding components. The outer end of the feeder 39 is urged toward the exterior wall 38 of the coupon tray 22 by means of a spring 48. A pin 49 on the feeder 39 helps to retain the spring 48 in position. The spring 48 urges the feeder 39 into contact with the exterior wall 38 of the coupon tray 22, thus holding each coupon 21 securely in position until removed by the patron.

As noted above, when the receptacle/advertising assembly 10 and coupon dispenser 20 are assembled together, they may be rotated as a single unit. Rotation is accomplished by mounting the receptacle/advertising assembly 10 and coupon dispenser 20 on a pedestal 30 of the "lazy susan" type. The operation of the lazy susan pedestal 30 is described with respect to FIGS. 5, 11 and 12. The pedestal 30 is provided with a central tower 50 which is received in a complementary recess 51 in the center of the bottom plate 24. The tower 50 is provided with an upstanding central pin 52 which is received in a central opening 53 of the bottom plate 24. The pedestal 30 is secured in a rotatable fashion to the bottom plate 24 by means of a retaining clip 54. A lower ball bearing channel 55 is molded into the pedestal 30 and an upper ball bearing channel 56 is molded into the bottom plate 24. Ball bearings 57 ride between the upper and lower ball bearing channels 55, 56 and are restrained by a bearing guide 58.

The present invention has been described with respect to certain preferred and alternative embodiments which are considered to be exemplary only and not limiting to the full scope of the present invention as set forth in the appended claims.

What is claimed is:

1. A tabletop advertising display for the presentation of selected advertising materials and for dispensing coupons to a patron of a place of business, comprising:

advertising display means for displaying the advertising materials to the patron;

coupon dispensing means for holding and dispensing coupons to the patron from a continuous flexible strip of coupons in roll form, said flexible strip having perforations between adjacent coupons to facilitate removal by the patron; and receptacle means for holding articles for selection by the patron;

wherein said advertising display means and said receptacle means are removably attached to said coupon dispensing means; and wherein said advertising display means, said receptacle means and said coupon dispensing means together comprise an advertising and dispensing assembly, further comprising rotation means for rotating the advertising and dispensing assembly to selectively present the advertising materials and the coupons to the patron; and wherein said coupon dispensing means comprises a plurality of coupon roll dispensers; and wherein said advertising display means comprises a plurality of advertisements and further wherein each of said plurality of advertisements is associated with at least one of said plurality of coupon roll dispensers whereby the subject matter of each of said advertisements is related to the use of a coupon dispensed by at least one of said coupon roll dispensers;

wherein said coupon dispensing means further comprises a coupon tray and a base plate, said coupon tray and said base plate having releasable interconnection means comprising a plurality of latching fingers disposed on said coupon tray having notches for interconnection with a corresponding plurality of slots disposed on said base plate; and wherein each of said plurality of coupon roll holders comprises a central spool for receiving a roll of coupons comprising a continuous flexible strip of coupons having perforations between adjacent coupons comprising a semi-circular segment between tear-away segments to facilitate removal by the patron;

a viewing slot for inspection of the quantity of coupons remaining in said coupon roll holder; and a channel formed between an exterior wall terminating in a knife edge and a spring loaded feeder whereby said coupons are fed from said coupon roll for removal by the patron.

2. The tabletop advertising display of claim 1, wherein said feeder further comprises an outward facing ramp whereby said semi-circular segment of each of said coupons is pushed outward to form a tab to facilitate removal by the patron.

3. The tabletop advertising display of claim 2 wherein said exterior wall further comprises a coupon window comprising clear material for viewing by the patron of a presented coupon from the end of a coupon roll.

* * * * *